US005741209A

United States Patent [19]

Hillebrand et al.

[11] Patent Number: 5,741,209

[45] Date of Patent: Apr. 21, 1998

[54] DRIVE FOR A FOLDING BLADE

[75] Inventors: Bernd Anton Hillebrand, Bergrheinfeld; Horst Bernhard Michalik, Höchberg, both of Germany

[73] Assignee: Koenig & Bauer-Albert Aktiengesellschaft, Wurzburg, Germany

[21] Appl. No.: 621,463

[22] Filed: Mar. 25, 1996

[30] Foreign Application Priority Data

Mar. 25, 1995 [DE] Germany ..... 195 11 054.4

[51] Int. Cl.[6] ..... B31F 1/08; B31F 1/10

[52] U.S. Cl. ..... 493/424; 493/425; 493/356; 493/359; 74/440

[58] Field of Search ..... 493/356, 424, 493/425, 359, 431; 270/5.01, 8, 20.1, 41; 74/440, 421 R

[56] References Cited

U.S. PATENT DOCUMENTS 2,919,914 1/1960 Harless .
4,190,243 2/1980 Michalik et al. .

FOREIGN PATENT DOCUMENTS 27 23 358 11/1983 Germany .
41 03 160 9/1994 Germany .

OTHER PUBLICATIONS

Japanese Document #37-2503; Feb. 1962.

*Primary Examiner*—James F. Coan
*Assistant Examiner*—Gene Kim
*Attorney, Agent, or Firm*—Jones, Tullar & Cooper, P.C.

[57] ABSTRACT

The folding blade spindle of a folding drum is rotatably driven by a single drive train that utilizes only one gear drive pair. The folding drum itself is rotated by a separate drive assembly. The use of only one gear drive pair for the folding blade spindle drive substantially reduces play in the folding blade and promotes accurate folding of printed products.

6 Claims, 2 Drawing Sheets

DRIVE FOR A FOLDING BLADE

FIELD OF THE INVENTION

The present invention is directed generally to a drive for a folding blade. More particularly, the present invention is directed to a drive for a folding blade in a folding drum. Most specifically, the present invention is directed to a drive for a folding blade spindle which carries a folding blade in a folding drum. The folding blade spindle is rotatable about its longitudinal axis and is supported in a rotatable folding drum generally parallel to the longitudinal axis of rotation of the folding drum. The folding blade spindle carries a spindle drive gear which is in gear mesh engagement with a drive gear wheel that is rotatably supported on an axle journal of the folding drum. The drive gear wheel is driven by a toothed belt pulley to which it is secured.

DESCRIPTION OF THE PRIOR ART

In the field of paper sheet folding, it is generally known to use a folding blade carried in a folding drum to make a fold in a sheet with the fold being aligned parallel with the direction of travel of the paper sheet. One such prior art device is shown in German Patent Publication No. DE-C-27 23 358, which corresponds to U.S. Pat. No. 4,190,243. In this prior device there is shown a linear folding device that is usable to make a fold in a paper sheet with the fold line extending generally parallel to the direction of travel of the sheet. A folding blade is positioned within a rotating folding blade drum. During each rotation of the folding blade drum, the elongated edge of the folding blade emerges from the folding blade drum and pushes the products to be folded between two parallel, spaced folding rollers that are positioned to cooperate with the folding blade.

In the prior U.S. Pat. No. 2,919,914 there is shown a drive arrangement for a folding blade spindle in a folding drum. In this linear folding device, the folding blade is carried by a folding blade spindle which is rotatable about its longitudinal axis and which is carried in the folding drum that is itself rotatably supported by spaced axle journals. The folding blade spindle of this prior art device also supports a gear wheel through which it is driven. The signatures to be folded are brought into position between the folding drum and a pair of rotatable folding rollers whose axes of rotation are parallel to that of the folding blade spindle and of the folding drum. The signatures are folded by being pushed by the folding blade into the space between the folding rollers.

In these prior art devices the folding blade typically has a significant amount of play. This play is often the cause of inaccurate or improperly aligned or positioned folds being made by the folding blade in the folded, printed producers. If the printed product is not folded along its midlength, one lateral edge will protrude or project beyond the other lateral edge after the fold has been accomplished. This gives rise to a folded product which has a poor appearance. A primary cause of folding blade spindle play is the fact that the rotation of the folding blade spindle is caused by cooperation of a gear wheel carried by the folding blade spindle by way of a planetary gear wheel that is in toothed engagement with a sun wheel that is carried on the folding blade drum. As the number of various gears in the gear drive train increases, and as the sizes of these gears also increase, the amount of gear wheel play also increases. This increased gear wheel play gives rise to the inaccurate operations of the folding blade discussed above and to the resultant inaccurate folds in the printed products.

It will be seen that a need exists for a folding blade drive arrangement which reduces play and which overcomes the limitations of the prior art. The drive for a folding blade in accordance with the present invention provides such a device and is a significant improvement over the prior art.

SUMMARY OF THE INVENTION

It is an object of the present invention to provide a drive for a folding blade.

Another object of the present invention is to provide a drive for a folding blade in a folding drum.

A further object of the present invention is to provide a drive for a folding blade spindle which carries a folding blade in a folding drum.

Still another object of the present invention is to provide a drive for a linear folding blade.

Yet a further object of the present invention is to provide a drive for a folding blade which will reduce folding blade play.

Yet still a further object of the present invention is to provide a drive for a folding blade that increases the accuracy of the folds formed by the folding blade.

As will be discussed in detail in the description of the preferred embodiment which is presented subsequently, the folding blade spindle, which carries a folding blade, is rotatably supported in a folding drum. The axes of rotation of the folding blade spindle and of the folding drum are parallel to each other. The folding drum has axle journals with one of these axle journals supporting a drive gear wheel which is rotatable with respect to the folding drum axle. A spindle drive gear is securely attached to the folding blade spindle. This spindle drive gear is engaged by the drive gear wheel. A toothed belt pulley or gear is fixedly joined to the drive gear wheel and is driven by a toothed drive belt. A drive force is applied to the spindle drive gear by the drive gear wheel from the toothed belt pulley or gear. An auxiliary runner or gear ring is located in contact with the spindle drive gear and has a tooth pitch which is one less than the spindle tooth pitch by one tooth. This insures that the spindle drive gear will remain in firm meshing contact with the drive gear wheel and thus will eliminate play between the spindle drive gear and the drive gear wheel. This elimination of play will increase folding accuracy.

It is the particular advantage of the present invention that this play in the folding blade will be almost completely eliminated by the provision of a separate drive train for the folding blade spindle. This separate folding blade spindle drive arrangement reduces the number of gear wheel pairings that are required to drive the folding blade spindle. The elimination of these gear wheel pairs reduces the amount of folding blade play. In addition, the utilization of the auxiliary runner in connection with the spindle drive gear also operates to eliminate or reduce gear wheel play and to thus increase folding blade accuracy.

The drive for a folding blade in accordance with the present invention increases the accuracy of the linear fold made by the folding blade. This also gives rise to an increased folding speed. The space required for the folding drum between the lateral frames which support the folding drum can be reduced by placing the separate drives for the folding blade spindle and for the folding drum on top of each other.

The drive for a folding blade in accordance with the present invention overcomes the limitations of the prior art. It is a substantial advance in the art.

BRIEF DESCRIPTION OF THE DRAWINGS

While the novel features of the drive for a folding blade in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE EMBODIMENT

Figure 1:
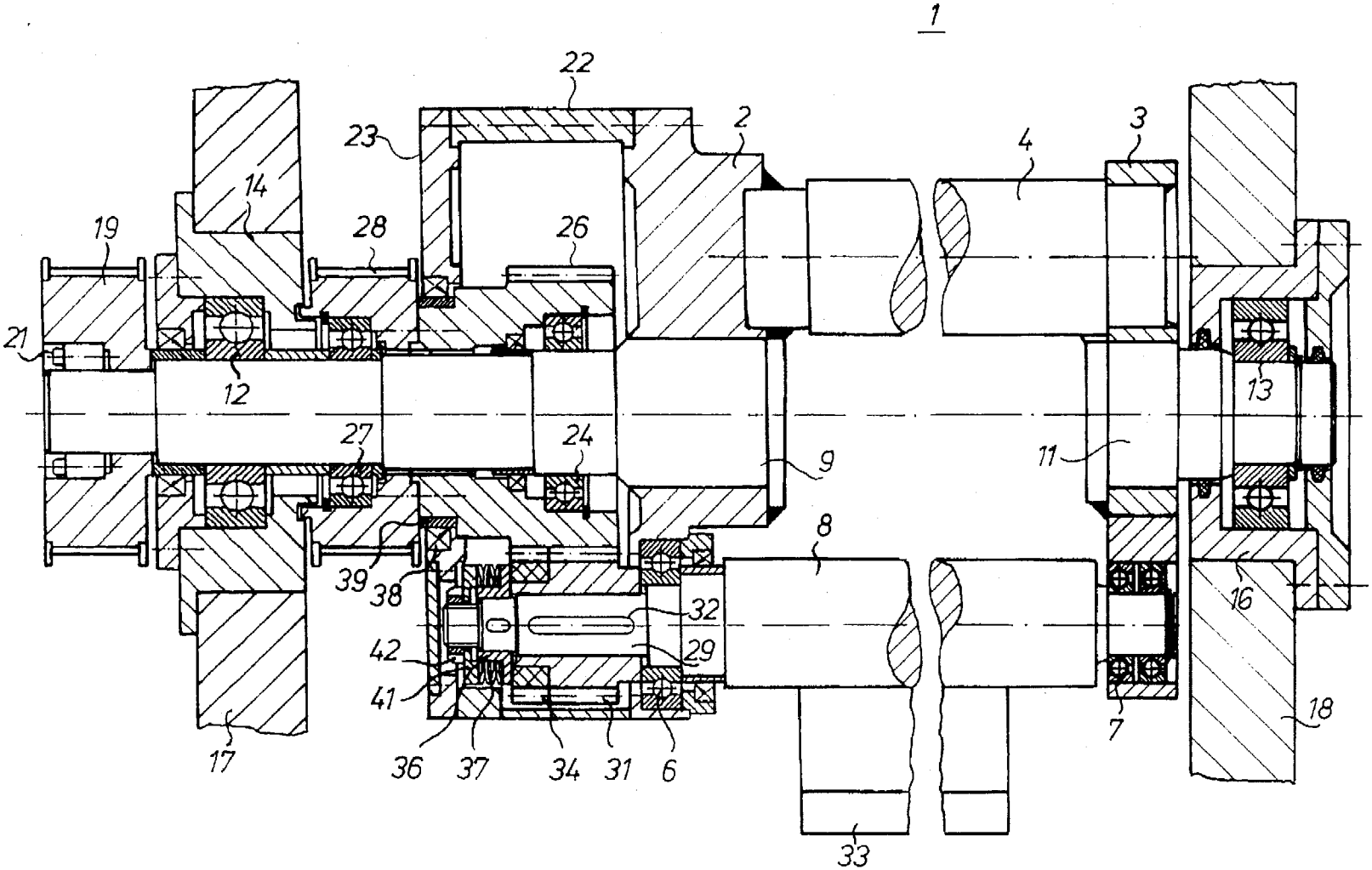
FIG. 1 is longitudinal cross-sectional view of a linear folding device with a drive for a folding blade in accordance with the present invention.

Referring initially primarily to FIG. 1, there may be seen, generally at 1, a folding blade drum or linear folding drum in which the drive for a folding blade in accordance with the present invention is utilized. It will be understood that the linear folder or folding drum 1 is utilized to form a linear fold in a sheet of printed product or in a signature in a direction parallel to the direction of travel of the printed product. It will be further understood that the folding drum 1 will typically be situated above a pair of spaced folding rollers whose axes are parallel to the axis of rotation of the folding drum 1. These folding rollers, and the rest of the press assembly with which the present invention will typically cooperate, are not shown or discussed since they form no part of the present invention.

Folding drum 1 is formed by spaced left and right lateral or end disks 2 and 3 which, as may be seen in FIG. 1, are connected by one or more cross bars 4. These end disks 2 and 3 are connected by the cross bars 4 at their respective diametric inner sides near the peripheries of the disks 2 and 3 and are spaced at a distance which corresponds to the length of the folding drum 1. One or more such cross bars 4 may be provided. The two end disks 2 and 3 of the folding drum 1 are also connected by a folding blade spindle 8 which extends between the two end disks 2 and 3 and which is parallel to an axis of rotation of the folding drum 1. The folding blade spindle 8 is supported in the left and right end disks 2 and 3 for rotation with respect to these end disks 2 and 3 by suitable ball bearing assemblies 6 and 7, respectively. The folding drum 1 is rotatably supported in spaced lateral frames 17 and 18 on suitable left and right folding drum axle journals 9 and 11, which are positively secured to the left and right lateral or end disks 2 and 3 respectively, as may be seen in FIG. 1. Each axle journal 9 and 11 is supported for rotation in its respective lateral frame 17 or 18 by appropriate ball bearings 12 and 13 and also by bushings 14 and 16.

An outer end of the first or left axle journal 9 is frictionally and interlockingly connected to a folding drum drive wheel 19. This folding drum drive wheel 19 may be, for example, a toothed belt pulley 19 which is secured to the end of the folding drum axle journal 9 by use of an annular clamping element 21. This annular clamping element 21 may be, for example, a generally well known double wedge. The folding drum drive wheel 19 is driven by a toothed drive belt from a main drive of the press and causes the folding drum 1 to rotate at a constant speed.

Again referring to FIG. 1, a generally annular, ring-shaped housing 22, which extends coaxially with the first axle journal 9, is attached at a first end to the left lateral disk 2. This ring-shaped housing 22 has a circular cover 23 at its second end which is closest to the left lateral frame 17. This housing 22 encloses a drive gear wheel 26 which is rotatably supported on the left axle journal 9 intermediate the left lateral disk 2 and the left lateral frame 17. The drive gear wheel 26 is supported on the left axle journal 9 for rotation with respect to the axle journal 9 by a suitable ball bearing assembly 24. This drive gear wheel 26 is fixedly connected with a drive wheel 28 which may be, for example, a toothed belt pulley 28. This toothed belt pulley 28 extends exteriorly of the ring shaped housing 22 and its circular cover 23 in the direction toward the left lateral frame 17.

The folding blade spindle 8 has a left axle journal 29, as may be seen in FIG. 1. This folding blade spindle left axle journal 29 also projects into the space to the left of the left lateral disk 2 of the folding drum which is defined by the annular housing 22 and the circular cover 23. A spindle drive gear or spindle gear wheel 31 is connected to the spindle left axle journal 29 and is fixed against relative rotation with respect to the spindle left axle journal 29 by means of a feather key 32. This spindle drive gear 31 is in gear meshing engagement with the drive gear wheel 26 which is rotatably supported on the left axle journal 9 of the folding drum 1. A radially outwardly extending folding blade is attached to the folding blade spindle 8 and is extendable radially out beyond a peripheral surface of the folding drum 1 in a generally known manner. A suitable counterweight is also secured to the folding blade spindle 8 to counterbalance the weight of the folding blade 33. This counterweight is not specifically shown in the drawings. The folding blade spindle 8 is driven by the spindle drive gear 31 from the drive gear wheel 26 which is firmly connected to the spindle drive wheel 28. This drive of the folding blade spindle 8 by only the single drive wheel pair 26 and 31 effects a substantial reduction in the play experienced by the folding blade 33 and thus greatly increases the folding accuracy of the folding blade 33 and also the speed at which the folding drum 1 can be operated.

A further reduction in the play of the folding blade 33 can be accomplished by the utilization of a so-called auxiliary runner 34 which cooperates with the spindle drive gear 31 and with the drive gear wheel 26. As may be seen in FIG. 1, the auxiliary runner 34, consists of a gear ring, also identified as 34 which has an external diameter the same as the spindle gear wheel 31 and which is positioned on the spindle shaft left axle journal 29 adjacent the spindle drive gear 31. This gear ring 34 is pressed against the left end face of the spindle drive gear 31 by means of a plate spring loaded annular flange 36. This annular flange 36 is connected to the left axle journal 29 of the folding blade spindle 8 and is fixed against rotation relative to this axle journal 29. In the preferred embodiment, the auxiliary runner 34 has its gear ring 34 provided with a tooth pitch on its circumference which is, for example, less by one tooth so that the spindle drive gear 31 is always maintained at a bias. The plate spring package is identified at 37, as depicted in FIG. 1, and is maintained at a pressure against the face of the annular flange 36 by means of a disk 41 and a shaft nut 42. The shaft nut 42 is threaded onto a screw threaded end of the folding blade spindle left axle journal 29.

The annular or ring-shaped housing 22 is seated by its cover disk 23 to an outer peripheral surface of the drive gear wheel 26 by a shaft gasket 38 and a spacer 39. This allows the drive gear wheel 26 and its connected spindle drive wheel 28 to rotate on the folding drum left axle journal 9 without loss of oil. Other suitable shaft gaskets, spacers, packing disks and the like are depicted in the drawings. Since they are generally conventional and operate in their usual manner, they are not discussed in detail.

In the operation of the folding drum 1 in accordance with the present invention, the folding drum 1 itself is caused to rotate by engagement of the folding drum drive wheel or toothed belt pulley 19 by a suitable toothed folding drum drive belt, which is not specifically shown in FIG. 1. Since this folding drum toothed belt pulley 19 is fixed on the folding drum left axle journal 9, the folding drum 1 will be rotated. The folding blade 33 is driven independently of the folding drum 1 by means of the rotation of the folding blade spindle 8. This folding blade spindle 8 is caused to turn in the folding drum by means of a separate toothed folding spindle drive belt which engages the spindle drive wheel or the spindle toothed belt pulley 28. This spindle drive wheel 28 is attached to the drive gear wheel 26 which meshes with the spindle drive gear 31. The gearing of the folding blade spindle drive train 28, 26, 31 is dimensioned such that the folding blade spindle 8 makes one revolution for each one revolution of the folding drum 1. Thus the folding blade 33 extends out from the folding drum 1 once during each revolution of the folding drum. This causes the tip of the folding blade 33 to move up and down along a perpendicular line above the pair of folding rollers with which it cooperates to form a linear fold in the printed products.

Figure 2:
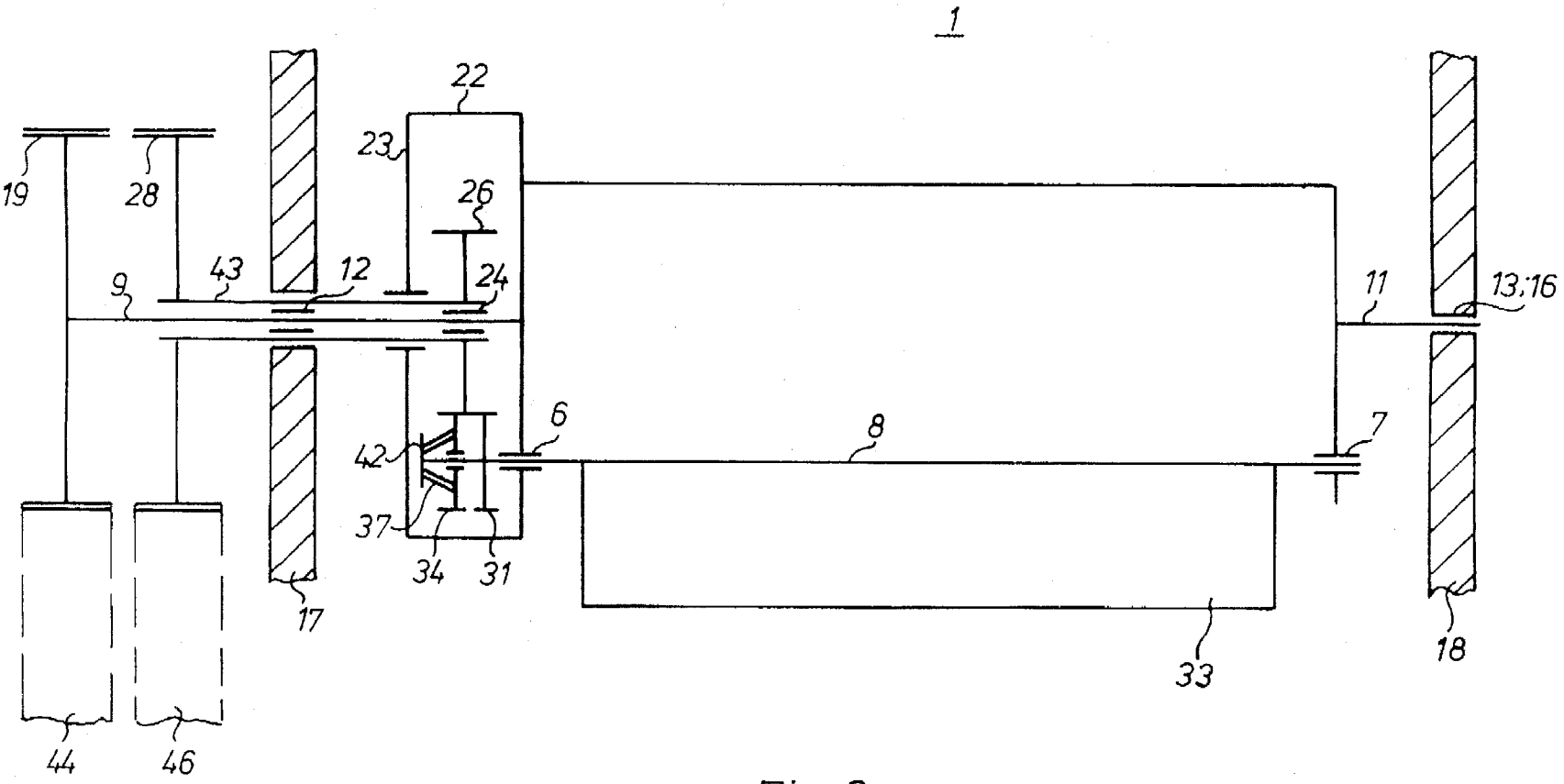
FIG. 2 is a schematic longitudinal view of the linear folding device with a second embodiment of the drive.

Turning now to FIG. 2, there may be seen an alternate embodiment of a drive arrangement for the folding blade spindle 8 in accordance with the present invention. In this alternate embodiment, the spindle drive wheel 28 is situated outside of the lateral frame 17, as opposed to inside of the lateral frame 17, as shown in FIG. 1. In this alternate embodiment, the spindle drive wheel 28 is connected to the drive gear wheel 26 for rotation therewith through the use of a bushing 43 or of a hollow connecting shaft which passes through the lateral frame 17 and which is concentric with the left axle journal 9 of the folding drum 1. In this alternate configuration very little space is required between the lateral frames 17 and 18 for driving the folding drum 1 and the folding blade spindle 8.

In the present invention, the toothed belt pulleys 19 and 28 are driven by means of toothed belts 44 and 46, as is shown schematically in FIG. 2. This type of drive results in a considerable noise reduction when compared with prior gear drive arrangements. The auxiliary runner 34 can, if desired, be omitted, or can be replaced by another assembly for the purpose of reducing toothed play. This will depend, to some extent, on the amount of play resulting from the spindle drive train 28, 26, 31 and also will depend on the required accuracy of the fold to be made by the folding blade.

While preferred embodiments of a drive for a folding blade in accordance with the present invention have been set forth fully and completely hereinabove, it will be apparent to one of skill in the art that a number of changes in, for example, the overall size of the folding drum, the printing press with which it is to be used, the type of printed product to be folded, and the like may be made without departing from the true spirit and scope of the present invention which is accordingly to be limited only by the following claims.

What is claimed is:

1. A drive for a folding blade in a folding drum of a printing press comprising:

first and second axle journals supporting said folding drum for a rotation about a folding drum axis of rotation;

a folding blade spindle rotatably supported in said folding drum and having at least a first folding blade spindle axle journal, said folding blade spindle supporting said folding blade for movement in said folding drum;

a spindle drive gear secured to said folding blade spindle axle journal;

a drive gear wheel rotatably supported on one of said first and second folding drum axle journals and in engagement with said spindle drive gear; and a spindle drive wheel connected to said drive gear wheel and rotatably supported on said one of said first and second folding drum axle journals, said spindle drive wheel having a driving force applied to it to rotate said folding blade spindle.

2. The drive in accordance with claim 1 further including an auxiliary runner in engagement with said spindle drive gear.

3. The drive in accordance with claim 1 further including a folding drum drive wheel fastened on said one of said first and second folding drum axle journals.

4. The drive in accordance with claim 1 further including spaced lateral frames supporting said folding drum and wherein said spindle drive wheel is interposed between said spaced lateral frames.

5. The drive in accordance with claim 1 further including spaced lateral frames supporting said folding drum and wherein said spindle drive wheel is disposed outside of said lateral frames.

6. The drive in accordance with claim 1 wherein said spindle drive wheel is a toothed belt pulley.

* * * * *